US005360181A

United States Patent [19]

Hayashi et al.

[11] Patent Number: 5,360,181

[45] Date of Patent: Nov. 1, 1994

[54] AUTO-PASTER FOR PASTING A PAPER WEB WHICH PREVENTS BOUNCING OF PRESSING MEMBERS

[75] Inventors: Mamoru Hayashi, Kawasaki; Tsuyoshi Okeyoshi, Tokyo, both of Japan

[73] Assignee: Tokyo Kikai Seisakusho, Ltd., Tokyo, Japan

[21] Appl. No.: 110,757

[22] Filed: Aug. 23, 1993

Related U.S. Application Data

[63] Continuation of Ser. No. 793,085, Nov. 15, 1991, abandoned.

[30] Foreign Application Priority Data

Nov. 29, 1990 [JP] Japan ..... 2-325786

[51] Int. Cl.[5] ..... B65H 21/00

[52] U.S. Cl. ..... 242/555.6; 242/555.3

[58] Field of Search ..... 242/58.3, 58.1; 156/504

[56] References Cited

U.S. PATENT DOCUMENTS 2,963,234 12/1960 Chase et al. ..... 242/58.3

3,861,612 1/1975 Kubo ..... 242/58.3

FOREIGN PATENT DOCUMENTS 51-9922 3/1976 Japan .

OTHER PUBLICATIONS

"Offset Printer" (the 1st. edition was issued on Sep. 15, 1983 by the GATF Far East Office).

"Offset Printer" (the 1st. edition was issued on Jun. 25, 1984 by Japan Printing Newspaper Office).

*Primary Examiner*—Daniel P. Stodola

*Assistant Examiner*—John Q. Nguyen

*Attorney, Agent, or Firm*—Armstrong, Westerman, Hattori, McLeland & Naughton

[57] ABSTRACT

An auto-paster adapted to press a paper web which is drawn out from one paper roll out of a plurality of paper rolls supported on a paper roll support frame, and which runs forward, against the circumferential surface of another paper roll by pressing members and bond the paper web to a paper web from the second-mentioned paper roll, having at least an operating force applying arrangement for operating the pressing members quickly so as to press the paper web in motion against the circumferential surface of the second-mentioned paper roll, and a pressing force applying arrangement for suppressing the bouncing of the pressing members occurring after the pressing members have come into operation, the auto-paster being further provided as necessary with a control apparatus for controlling the operation timing of the pressing force applying arrangement.

5 Claims, 3 Drawing Sheets

AUTO-PASTER FOR PASTING A PAPER WEB WHICH PREVENTS BOUNCING OF PRESSING MEMBERS

This application is a continuation of application Ser. No. 07/793,085 filed Nov. 15, 1991, now abandoned.

BACKGROUND OF THE INVENTION

1. Field of the Invention

This invention relates to a so-called flying (speed matching type) auto-paster adapted to rotate a paper roll on standby so that a peripheral speed of the paper roll becomes substantially equal to a travelling speed of a moving paper web, and bond a front end portion of a paper web from the paper roll and the moving paper web together.

2. Description of the Prior Art

The conventional flying type auto-pasters include as an example an auto-paster disclosed in "Offset Printer" (the first edition was issued on Sept. 15, 1983 by the GATF Far East Office), page 45, left column, line 6, and described as follows.

First, an auto-paster P', the basic construction of which is, for example, as shown in FIG. 3, is provided adjacently to a paper roll support frame (spider) R' in a web feeder (not shown) with auto-paster frames 2' supported pivotably on the web feeder via a support shaft 1', the auto-paster P' being adapted to be turned forward and backward around the support shaft 1' as a fulcrum between a standby position Y' and a pasting position Z' by a auto-paster displacing means (not shown) attached to the web feeder.

A pressing member 3' and a cutter 5' are supported pivotably on the auto-paster frame 2' via support shafts 4', 6' respectively, and springs 7', 8' for respectively operating the pressing member 3' and cutter 5' are connected thereto. The pressing member support shaft 4' and cutter support shaft 6' are provided with stopper locking members 9', 10', which are adapted to engage one ends of respective bell crank type stoppers 13', 14' provided on the auto-paster frames 2 so that the stoppers 13', 14' are turned around respective pins 11', 12' as fulcrums, whereby the pivotal movements of the pressing member 3' and cutter 5' are stopped. The other ends of the bell crank type stoppers 13', 14' are opposed to the free ends of rods of respective solenoids 15', 16' fixed to the auto-paster frames 2', and, in accordance with the operations of the solenoids 15', 16', the bell crank type stoppers 13', 14' are turned around the pins 11', 12' as fulcrums to cause the stopper locking members 9', 10' and the first-mentioned ends of the stoppers 13', 14' to be disengaged from each other.

In the web feeder having the above-described auto-paster, the pasting of paper web is done in the following manner.

When the diameter of a paper roll (which will hereinafter be referred to as an old paper roll) O' from which a paper web W' is being payed out decreases and reaches a first predetermined level, a paper roll (which will hereinafter be referred to as a next paper roll) N' on standby and supported on a paper roll support frame R' is transferred to a pasting standby position (a position shown in the drawing) in accordance with the displacement of the paper roll support from R', and an auto-paster P' is displaced from a standby position Y' to a pasting position Z'. The front end portion of the next paper roll N' is provided in advance with a bonding agent B' for use in pasting the same paper web to the moving paper web W'.

The next paper roll N' which has reached the pasting standby position is rotated by a suitable next paper roll driving means D', and the acceleration of this paper roll N' is continued until the peripheral speed thereof has become substantially equal to the travelling speed of the paper web W' in motion.

When the diameter of the paper roll O' further decreases to reach a second predetermined level after the peripheral speed of the next paper roll N' has become substantially equal to the travelling speed of the paper web W' in motion, a suitable detecting means S detects the front end portion of the next paper roll N' or the position of the bonding agent B' provided thereon, and outputs a pasting signal.

In accordance with this pasting signal, the pressing member 3' in the auto-paster P' is operated to press the paper web W' in motion against the outer circumferential surface of the next paper roll N'. In this mechanism, the solenoid 15' is operated to turn the stopper 13'. Consequently, the stopper 13' and stopper locking member 9' are disengaged from each other, and the pressing member 3' is turned around the pressing member support shaft 4' due to the force of the operating force applying means 7' to press the paper web W' in motion against the outer circumferential surface of the next paper roll N'.

The paper web W' in motion then continues to move, and the next paper roll N' continues to rotate. As a result, the front end portion of the next paper roll N' reaches the position in which the paper web W' in motion is pressed, and it is pasted on the paper web W' in motion with the bonding agent B' provided on the front end portion of the next paper roll N'.

The cutter 5' in the auto-paster P' is then operated to cut the paper web W' in motion in a position which is closer to the old paper roll O' than to the position in which the front end portion of the next paper roll N' is bonded to the paper web W' in motion. In this mechanism, the solenoid 16' is operated to turn the stopper 14'. Consequently, the stopper 14' and stopper locking member 10' are disengaged from each other, and the cutter 5' is turned around the cutter support shaft 6' due to the force of the operating force applying means 8' to cut the paper web W' in motion.

This completes the paper pasting operation, and the auto-paster P' is displaced to the standby position Y'. Also, the next paper roll N' is released from the driving force of the next paper roll driving means D'. The pressing member 3' and cutter 5' are returned to their original positions by suitable means (not shown) while the auto-paster P' is displaced to the standby position.

What is disclosed in Japanese Utility Model Publication No. 9922/1976 will be described below as another example of a prior art flying type auto-paster.

According to this example, the process of displacement of an auto-paster from a standby position to a pasting position is different from that in the above-described example shown in FIG. 3, and an auto-paster displaying means consists of a dual air cylinder with a hydraulic cylinder connected to the auto-paster, the dual air cylinder and hydraulic cylinder of the auto-paster are interlocked.

When the diameter of an old paper roll in this arrangement decreases to a first reference level, one air cylinder member of the dual air cylinder is operated to displace the auto-paster to a pasting preparation position which is between a standby position and a pasting position and closer to the pasting position. The other air cylinder member of the dual air cylinder is operated in accordance with a pasting signal outputted after the diameter of the old paper roll has decreased to a second reference level, to displace the auto-paster speedily from the pasting preparation position to the pasting position and operate a brush which constitutes the pressing member, whereby the paper web in motion is pressed against the outer circumferential surface of the next paper roll to carry out a paper pasting operation.

During this paper pasting operation, the hydraulic cylinder and dual air cylinder are interlocked with each other, and a bouncing phenomenon of the auto-paster occurring when the auto-paster is displaced speedily from the pasting and stopped therein is prevented and offset by a hydraulic pressure exerted on this hydraulic cylinder.

After the paper web in motion has been pasted, it is cut to complete a paper pasting operation, and this final step is identical with that in the example shown in FIG. 3.

The second conventional flying type auto-paster described above is used in practice mostly in the case where the traveling speed of the paper web is high. An operation for pressing the paper web in motion against the outer circumferential surface of the next paper roll by the pressing member, which is adapted to be operated in accordance with a pasting signal outputted from a detecting means when it has detected the front end portion of the next paper roll in rotary motion or the bonding agent provided on this portion of the paper roll, has to be carried out before the arrival of the bonding agent at the position of the starting of the operation of the pressing member after the operation of the detecting means, so that this paper web pressing operation is carried out speedily.

Therefore, the pressing member pressing the paper web in motion against the outer circumferential surface of the next paper roll during this operation bounces due to a reaction force of the next paper roll occurring in response to the pressing force of the pressing member. Consequently, it takes a considerable period of time as shown in FIG. 4*b* before the pressing member stops with its pressing force properly stabilized, and the level of the force thereof with which the paper web in motion is pressed against the outer circumferential surface of the next paper roll becomes uneven during this time. As a result, a timing of arrival of the bonding agent at the position in which the pressing member operates and the bouncing condition of the pressing member may result in imperfect or unsuccessful bonding of the paper web in motion and the front end of the next paper roll to each other.

SUMMARY OF THE INVENTION

An object of the present invention is to enable a flying type auto-pasting operation to be carried out with a high reliability by suppressing the bouncing of a pressing member, which occurs after the pressing member has been operated speedily, so as to bring the pressing member to rest quickly with respect to the outer circumferential surface of a next paper roll, minimize the variations of the level of the pressing force of the pressing member, which occur due to the bouncing of the pressing member, and stabilize the pressing force thereof speedily and properly.

The auto-paster according to the present invention, in which a paper web which is payed out from one paper roll out of a plurality of paper rolls supported on a paper roll support frame, and which is in motion, is pressed by a pressing member against the circumferential surface of another paper roll so as to be bonded to the paper web therefrom, characterized in that the auto-paster is provided with at least a means for applying an operating force for actuating a pressing member so as to press a paper web in motion from one paper roll against the circumferential surface of another paper roll, and a means for applying a pressing force for suppressing the bouncing of the pressing member which occurs after the pressing member has received the mentioned operating force, the auto-paster being further provided as necessary with a control means for regulating the timing of actuation of the pressing force applying means.

A paper pasting operation of this auto-paster is carried out as follows.

At a point in time at which a paper web from a next paper roll on standby the peripheral speed of which is substantially equal to the travelling speed of a paper web in motion and drawn out from a paper roll in a web feeder is pasted on the latter paper web, the operating force applying means is operated suddenly, so that the pressing member is pressed from the upper side of the paper web in motion against the next paper roll to carry out a paper pasting operation. During this paper pressing operation, in which a reaction force of the next paper roll is exerted on the pressing member, the pressing force applying means is operated to apply a pressing force to the pressing member and prevent this reaction force from causing the pressing member to be bounced. Thus, the time required for the pressing member to come to rest with respect to the outer circumferential surface of the next paper roll, and for the pressing force of the pressing member to be stabilized properly decreases, and variations occurring during this time in the level of the force with which the pressing member presses the paper web in motion against the next paper roll can be controlled to a minimum.

Since the operating force applying means and pressing force applying means are operated at different times, the timing of the operations thereof is controlled by the control means.

BRIEF DESCRIPTION OF THE DRAWINGS

Other objects, features and advantages of the present invention will be described in the following with reference to the accompanying drawings, in which.

DESCRIPTION OF THE PREFERRED EMBODIMENT

The auto-paster embodying the present invention will now be described with reference to FIGS. 1 and 2.

Figure 1:
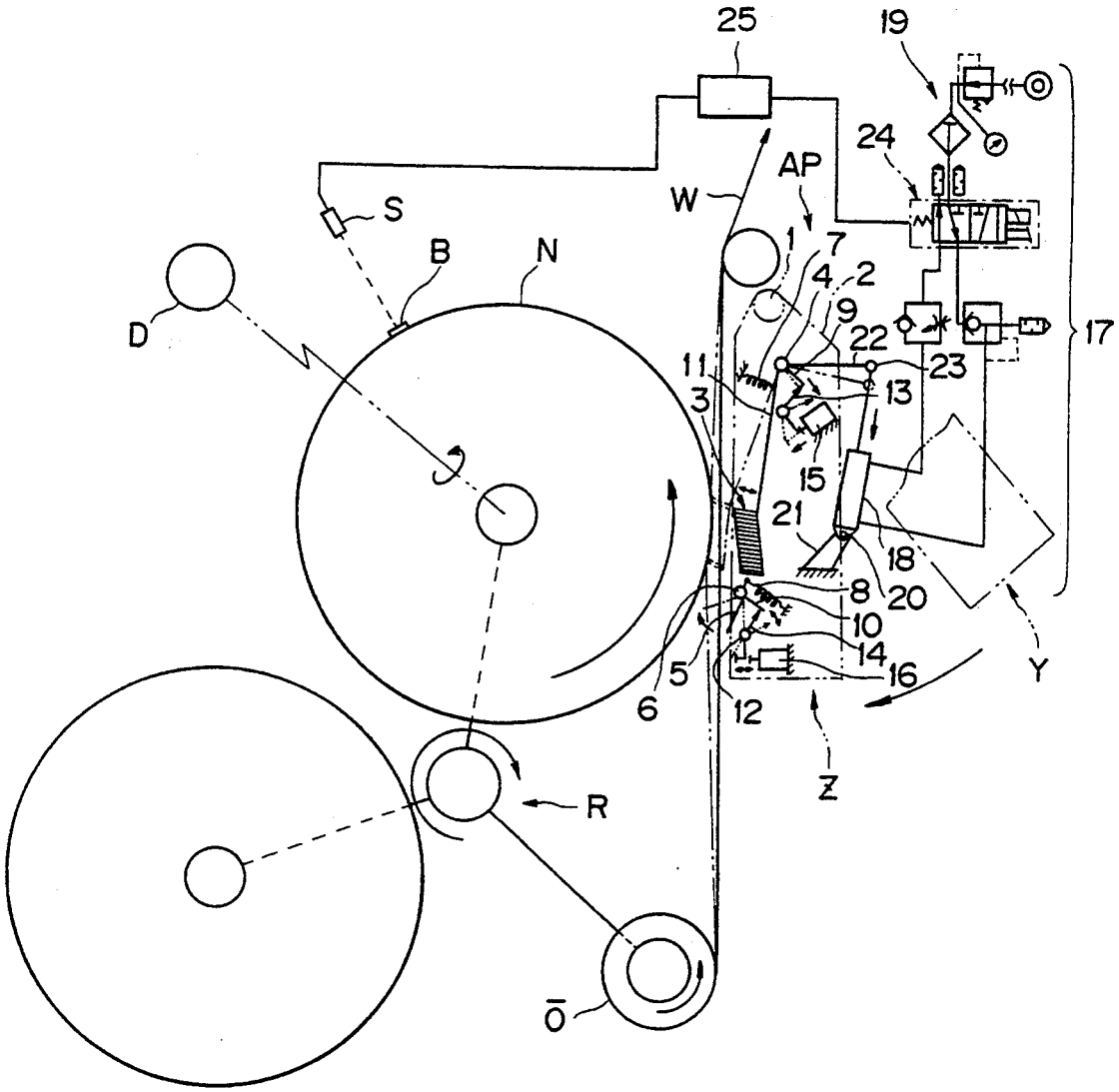
FIG. 1 is a front elevation of a web feeder provided with an auto-paster embodying the present invention.

As shown in FIG. 1, an auto-paster AP provided adjacently to a paper roll support frame R on a web feeder (not shown) has auto-paster frames 2 supported pivotably on the web feeder via a support shaft 1 and adapted to be turned by an auto-paster displacing means (not shown and consisting, for example, of a fluid pressure cylinder) attached to the web feeder (not shown), whereby the auto-paster frames 2 are displaced pivotally forward and backward around the support shaft 1 between a standby position Y and a pasting position Z.

Figure 2:
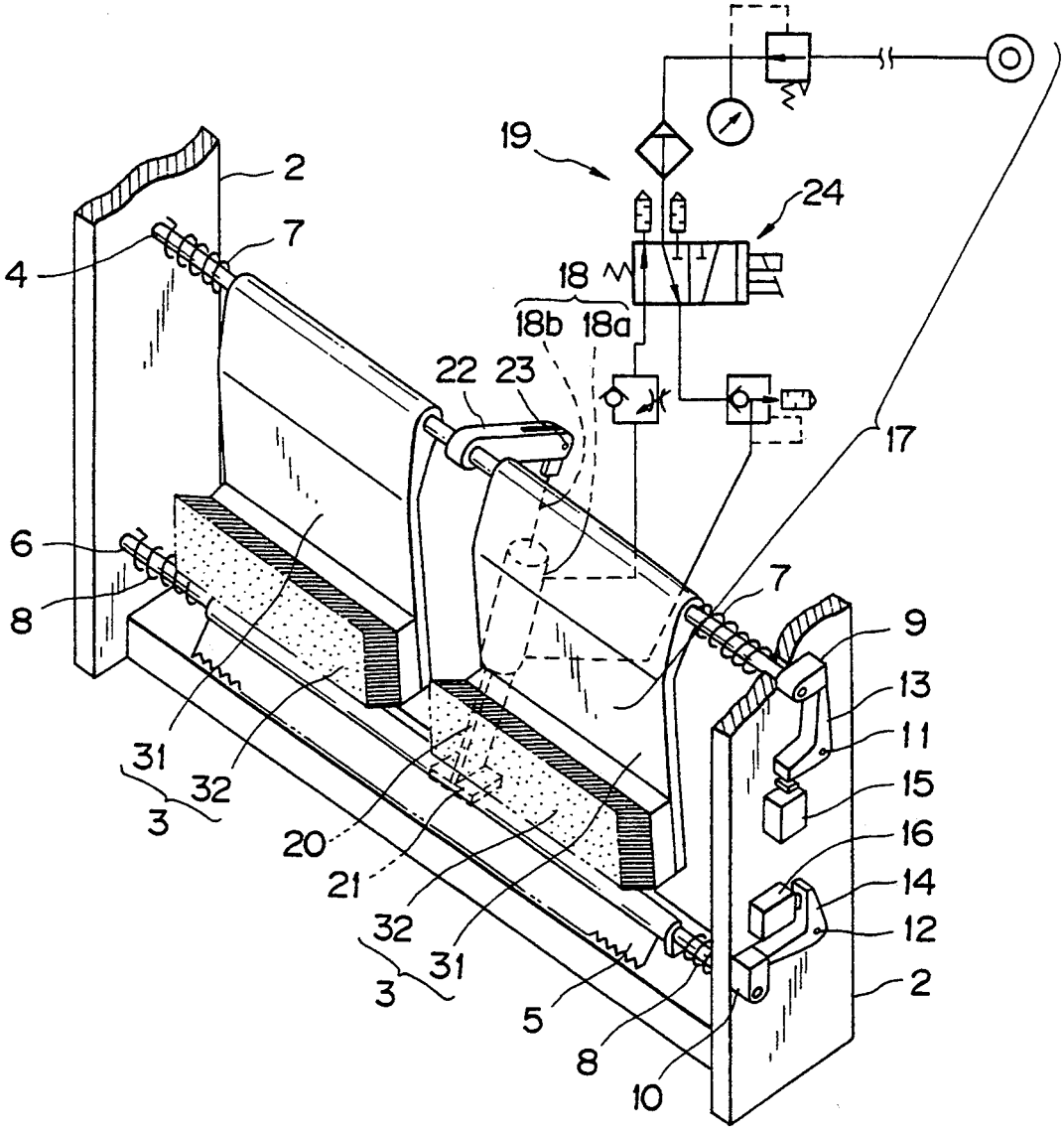
FIG. 2 is a perspective view of the auto-paster embodying the present invention.
Figure 3:
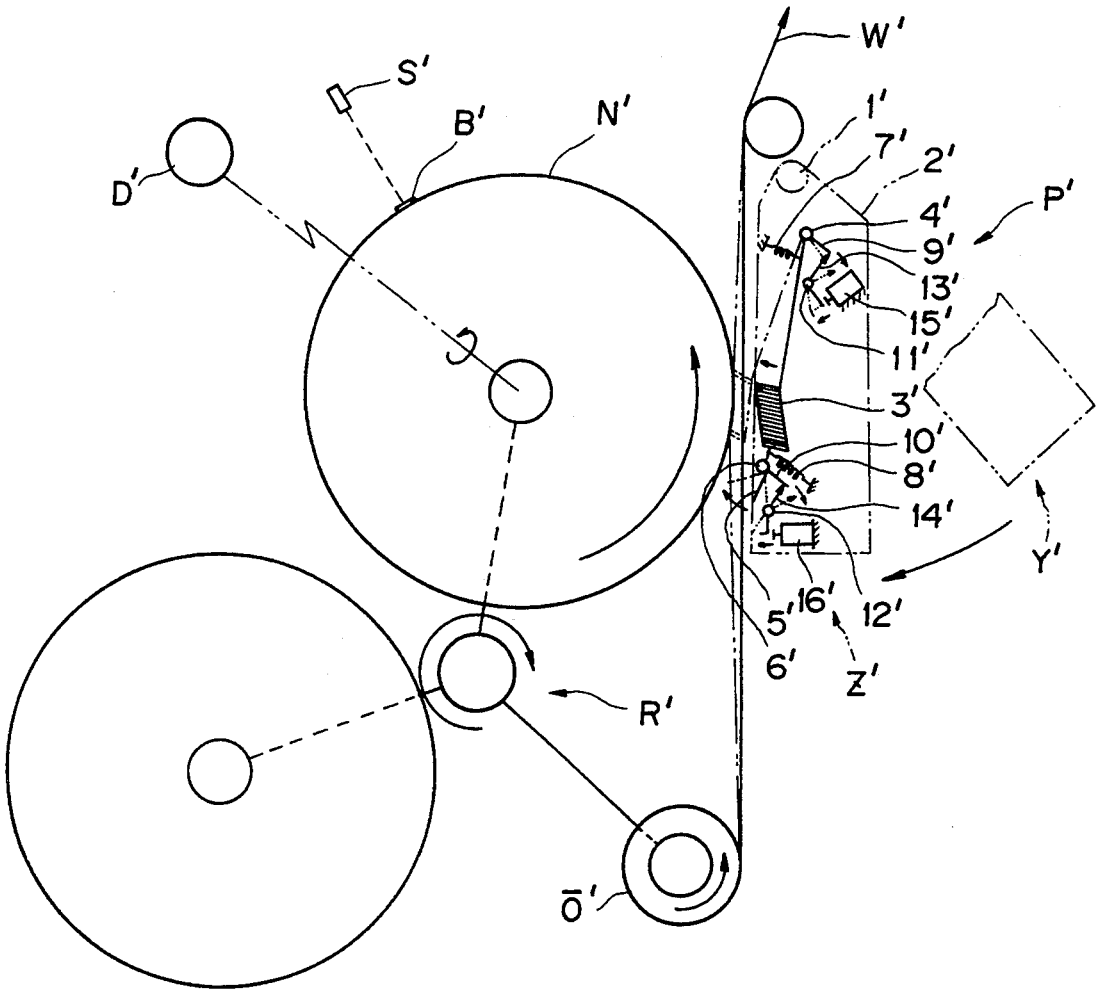
FIG.3 PRIOR ART
FIG. 3 is a front elevation of a prior art auto-paster.
Figure 4A:
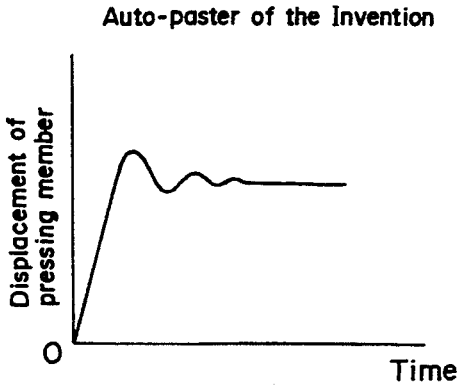
FIG. 4 gives graphs respectively showing the relation between the quantity of displacement of a pressing member and the lapse of time in the auto-paster embodying the present invention and that in a prior art auto-paster.
Figure 4B:
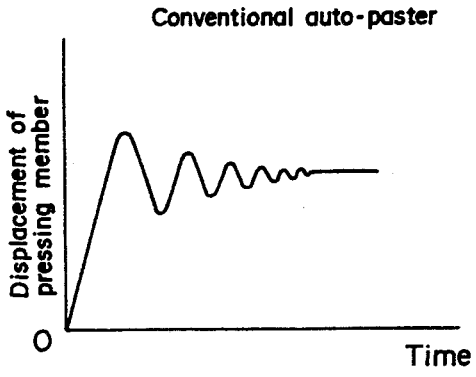
FIG.4(b) PRIOR ART

In the auto-paster AP shown in FIG. 2, a pressing member support shaft 4 and a cutter support shaft 6 which are arranged in parallel with each other are supported at both end portions of each thereof on the auto-paster frames 2 so that these shafts can be turned, and the pressing member support shaft 4 is positioned on the downstream side of the cutter support shaft 6 with respect to a paper web in motion. A pair of pressing members 3, 3 are fixed to the pressing member support shaft 4. Each pressing member 3 is formed by attaching a brush 32 to the free end portion of a pivotable arm 31 which is fixed at its base portion to the pressing member support shaft 4. A cutter 5 is fixed to the cutter support shaft 6. Stopper locking members 9, 10 are attached to the projecting outer end portions of the pressing member support shaft 4 and cutting support shaft 6.

On the inner side of the auto-paster frames 2, coiled springs 7, 7 constituting operating force applying means and wound around both end portions of the pressing member support shaft 4 are joined at their respective one end to the pivotable arms 31 of the pressing members 3, 3, and at the other ends thereof to the auto-paster frames 2. Similarly, coiled springs 8, 8 wound around both end portions of the cutter support shaft 6 are joined at their respective one end to the cutter 5, and at the other ends thereof to the auto-paster frames 2.

The stopper locking members 9, 10 are adapted to engage one end of bell crank type stoppers 13, 14, which are provided on the auto-paster frame 2 so that the stoppers are turned around pins 11, 12 as fulcrums, and thus stop the turning of the pressing member 3 and cutter 5. The other ends of the bell crank type stoppers 13, 14 are opposed to the free ends of the rods of solenoids 15, 16 attached to the auto-paster frame 2, and these stoppers 13, 14 are turned around the pins 11, 12 as fulcrums by the excitation of the solenoids 15, 16 to disengage the stopper locking members 9, 10 and the ends opposed thereto of the stoppers 13, 14 from each other.

The auto-paster AP is further provided with a pressing force applying means 17 consisting of a fluid cylinder 18 and a fluid circuit 19.

A cylinder body **18*a* of the fluid cylinder 18 is fixed pivotably by a pin 20 via a bracket 21 to the auto-paster frames 2, and the free end of a piston rod 18*b* of the cylinder 18 is connected pivotably by a pin 23 to one end of a pivotable arm 22 the other end of which is fixed to the pressing member support shaft 4. The fluid circuit 19 is provided with a pressure fluid supply source pressure regulating valve, and a conduit connecting the pressure fluid supply source pressure regulating valve and the fluid cylinder 18 together via a solenoid operated direction control valve 24**.

A control means 25 into which an output signal from a suitable sensor S, which is provided in a position opposed to the outer circumferential surface of a next paper roll N in the paper roll support frame R as shown in FIG. 1, is inputted consists of an exciting current circuit provided with the solenoids 15, 16 and a set value-variable timer for controlling the switching of the solenoid operated direction control valve 24.

Each pressing member 3 illustrated in FIG. 2 uses the brush 31, which may be replaced by a brush roller or a roller the circumferential surface portion of which consists of an elastic material.

A pasting operation by this auto-paster AP is carried out in the following manner.

When the diameter of a paper roll (which will hereinafter be referred to as an old paper roll) O from which a paper web W is being payed out decreases and reaches a first predetermined level, a paper roll (which will hereinafter be referred to as a next paper roll) N on standby and supported on a paper roll support frame R is transferred to a pasting standby position (a position shown in the drawing) in accordance with the pivotal displacement of the paper roll support frame R, and the auto-paster AP is turned around the support shaft 1 as a fulcrum by an auto-paster displacing means (not shown and consisting, for example, of a fluid cylinder) to be displaced from the standby position Y to the pasting position Z. The front end portion of the paper web in the next paper roll N is provided in advance with a bonding agent or a double coated adhesive tape (which will hereinafter be referred to as a bonding material) B for use in a paper web pasting operation.

The next paper roll N which has reached the pasting standby position is then rotated by a suitable next paper roll driving means D and accelerated until the peripheral speed of the roll has become substantially equal to the travelling speed of the paper web W in motion.

When the diameter of the paper roll O further decreases to reach a second predetermined level after the peripheral speed of the next paper roll N has become substantially equal to the travelling speed of the paper web W in motion, a detecting means S detects the front end portion of the next paper roll N or the position of the bonding material B provided thereon, and outputs a paper pasting signal.

First, an exciting current flows from the control means 25 on the basis of this paper pasting signal, and the solenoid 15 is energized instantly, so that the stopper 13 is turned clockwise in FIG. 2 around the pin 11. Consequently, the stopper 13 and stopper locking member 9 are disengaged from each other, and the pressing member support shaft 4 is turned clockwise in FIG. 2 due to the resilient force of the coiled spring 7. As a result, the pressing members 3 turned by this shaft 4, i.e. the brushes 32 on the free end portions of the pivotable arms 31 press the paper web W in motion against the outer circumferential surface of the next paper roll N.

In the meantime, a pressing force applying means operating signal is outputted from the control means 25 with a slight time lag in accordance switch an operation of the timer, so that the pressing force applying means 17 is operated. Namely, an exciting current for the solenoid operated direction control valve 24 is outputted from the control means 25 with a slight time lag in accordance with an operation of the timer. Consequently, a spool in the solenoid operated direction control valve 24 is displaced from the position shown in FIG. 2 to the left to switch the passage between the pressure fluid supply source pressure regulating valve and the fluid cylinder 18. This causes the piston rod **18*b* of the fluid cylinder 18 to retract, and the pivotable arm 22 to turn clockwise in FIG. 2, so that the pivotable arms 31 of the pressing members 3 are urged so as to be turned clockwise as well via the pressing member support shaft 4**.

When the solenoid 15 is energized as previously mentioned, to cause the brushes 32 to press the paper web W in motion against the outer circumferential surface of the next paper roll N, a reaction force for repelling the brushes 32 and turning the pivotable arms 31 counter-clockwise in FIG. 2 against the force of the coiled springs 7 occurs in the next paper roll N but the pivotable arms 31 are urged so as to be turned clockwise owing to the operation of the fluid cylinder 18 as described above. Accordingly, the repulsion of the brushes 32 due to the reaction force of the next paper roll N is suppressed, and the time required for the brushes 32 to come to rest with respect to the outer circumferential surface of the next paper roll N, and for the paper web pressing force to be properly stabilized is reduced, and variations occurring during this time in the level of the force for pressing the paper web W in motion against the next paper roll N can be controlled to a minimum.

The paper web W in motion keeps running, and the next paper roll N rotating in this condition. Consequently, the front end portion of the paper web from the next paper roll N reaches the position in which the paper web W in motion is pressed, and it is brought into contact at the bonding material B provided thereon with the paper web W in motion. During this time, the force of the brushes 31 for pressing the paper web W in motion against the outer circumferential surface of the next paper roll N is controlled to a minimum of variation, or properly stable as mentioned above. Accordingly, the bonding of the front end portion of the paper web from the next paper roll N and the paper web W in motion to each other with the bonding material B is done reliably.

The solenoid 16 is then energized instantly with an exciting current outputted with a suitable length of time lag from the control means 25 on the basis of the operation of the timer, so that the stopper 14 is turned clockwise in FIG. 2 around the pin 12. As a result, the stopper 14 and stopper locking member 10 are disengaged from each other, and the current support shaft 6 is turned clockwise in FIG. 2 owing to the resilient force of the coiled spring 8, whereby the paper web W in motion is cut with the cutter 5, which is turned by this shaft 6, in a position which is closer to the old paper roll O than to the position in which the paper web W is bonded to the paper web from the next paper roll N.

When the cutting of the paper web has been completed, the auto-paster AP is turned around the support shaft 1 by an auto-paster displacing means (for example, a fluid cylinder) to return from the pasting position Z to the standby position Y. At around this time, the exciting current supplied to the solenoid operated direction control valve 24 is cut off by the control means 25, so that the spool of this valve 24 is displaced to the position shown in FIG. 2, to switch the passage between the pressure fluid supply source pressure regulating valve and the fluid cylinder 18. As a result, the piston rod **18*b* of the fluid cylinder 18 extends to cause the pivotable arm 22 to be turned counter-clockwise in FIG. 2, so that the pivotable arms 31 of the pressing members 3 are urged so as to be turned counter-clockwise as well via the pressing member support shaft 4. The solenoids 15, 16 are then de-energized. While the auto-paster AP is displaced to the standby position, the pressing member support shaft 4 and cutter support shaft 6 are turned counter-clockwise in FIG. 2 against the resilient force of the coiled springs 7, 8 by a suitable known means (not shown) to move back the brushes 32 and cutter 5 to the original positions, and turn the stoppers 13, 14 counter-clockwise as well around the pins 11, 12 by a suitable known means (not shown) and engage the same with the stopper locking members 9, 10**.

The next paper roll N is released from the driving force applied thereto by the next paper roll driving unit D.

During the above-described operation, a well-matched timing between the operation of the pressing force applying means 17 and the repulsion of the pressing members 3 produces a very remarkable effect. Accordingly, the timing of generation of a pressing force applying means operating signal is regulated suitably by the control means 25. The delay time of the operation of the pressing force applying means 17 with respect to the operation of the pressing members 3 is very short, so that, even if there is a slight difference between the timing of operation of the pressing force applying means 17 and that of occurrence of repulsion of the pressing members 3, a satisfactory practical effect is obtained. Therefore, even if the conduit between the solenoid operated direction control valve 24 in the fluid circuit 19 and the fluid cylinder 18 therein is made comparatively long with the control means 25 removed from the auto-paster in this embodiment, a practical effect can be obtained.

Namely, according to this arrangement, the solenoid 15 and solenoid operated direction control valve 24 are actuated at substantially the same time in accordance with a pasting signal but the termination of the operation of the valve 24 is delayed due to the differences in construction between the solenoid 15 and valve 24. Moreover, the length of the conduit is large. Consequently, the transmission of the fluid pressure to the fluid cylinder 18 is delayed. Therefore, the time at which the pressing force of the pressing member 3 is delayed slightly with respect to the operation of the pressing members 3, which are adapted to be operated simultaneously with the termination of the operation of the solenoid 15 in accordance with the energization of the operating force applying means 7, and, as a result, a good operational effect is produced.

The present invention is not limited to the above embodiment. For example, the operating force applying means may consist of some other means (for example, a fluid cylinder connected to the fluid circuit) instead of the coiled springs 7 shown in FIGS. 1 and 2.

When a fluid cylinder is used for the operating force applying means, the stopper locking members 9, 10, stoppers 13, 14 and solenoids 15, 16 may not be provided. In this case, the fluid cylinder 18 in the pressing force applying means 17 shown in FIGS. 1 and 2 may be removed, and a conduit in the fluid circuit for the application of a pressing force may be connected in parallel with a conduit in the fluid circuit for the application of an operating force to the fluid pressure supply port of a fluid cylinder used as the operating force applying means to supply pressure fluids of predetermined levels from the conduits in these fluid circuits. In such an arrangement, the fluid circuit for the application of a pressing force corresponds to the pressing force applying means defined in the claims of the present invention.

As is understood from the graphs in FIGS. **4*a* and 4*b***, the flying type pasting operation according to the present invention enables as compared with the prior art pasting operation the pressing members to come to rest quickly with respect to the outer circumferential surface of the next paper roll by suppressing the bouncing of the pressing members occurring after these members have been operated speedily, the variation, which occurs due to the bouncing of the pressing members, of the pressing force of the pressing members to be minimized, and the pressing force to be stabilized quickly to a proper level. Accordingly, a pasting operation of a high reliability can be carried out, and a decrease in the operation efficiency which is ascribable to the imperfect pasting of paper webs can be prevented.

Anyway, the auto-paster according to the present invention includes auto-pasters of modified design not departing from the scope of the appended claims.

We claim:

1. An auto-paster for pasting a paper web which is being drawn out from one paper roll supported on a paper roll support frame, against a circumferential surface of another paper roll to bond said paper web to another paper web from said another paper roll, comprising:

pressing members;

an operating force applying means for operating said pressing members to press quickly said paper web in motion against the circumferential surface of said another paper roll;

a pressing force applying means for suppressing bouncing of said pressing members which occurs after said pressing members have pressed the web into contact with said circumferential surface by applying an additional force urging said pressing members to press said paper web in motion against the circumferential surface of said another paper roll; said pressing force applying means including a fluid cylinder connected to said pressing members and a solenoid control valve connected to said fluid cylinder for actuating said fluid cylinder to apply said additional force urging said pressing members to press said paper web in motion against the circumferential surface of said another paper roll;

a sensor detecting a front end portion of said another paper roll and producing an output signal in response to detection of said front end portion of said another paper roll; and a control means receiving said output signal from said sensor for controlling said operating force applying means and said pressing force applying means, said control means producing a control signal in response to said output signal from said sensor; and wherein said solenoid control valve is connected to receive said control signal from said control means and is responsive to said control signal to actuate said fluid cylinder to cause said pressing force applying means to apply said additional force urging said pressing members to press said paper web in motion against the circumferential surface of said another paper roll, so as to prevent bouncing of said pressing members.

2. An auto-paster according to claim 1, wherein said control means controls an operation timing of said pressing force applying means.

3. An auto-paster for pasting a paper web which is being drawn out from one paper roll supported on a paper roll support frame, against a circumferential surface of another paper roll to bond said paper web to another paper web from said another paper roll, comprising:

pressing members;

an operating force applying means for operating said pressing members to press quickly said paper web in motion against the circumferential surface of said another paper roll; wherein said operating force applying means includes a first drive system for driving said pressing members, said first drive system including a spring exerting a force urging said pressing members into pressing contact with said paper web in motion against the circumferential surface of said another paper roll;

a pressing member applying means for exerting an additional force urging said pressing members into pressing contact with said paper web in motion against the circumferential surface of said another paper roll, for suppressing bouncing of said pressing members which occurs after said pressing members have pressed the web into contact with said circumferential surface; wherein said pressing member applying means includes a second drive system for driving said pressing members, said second drive system including a fluid cylinder connected to said pressing members and a solenoid control valve connected to said fluid cylinder for actuating said fluid cylinder to exert said additional force urging said pressing members into pressing contact with said paper web in motion against the circumferential surface of said another paper roll, to prevent bouncing of said pressing members; and a control means producing a control signal for controlling said operating force applying means and said pressing member applying means; and wherein said solenoid control valve of said pressing member applying means is responsive to said control signal in order to cause said pressing member applying means to exert said additional force urging said pressing members into pressing contact with said paper web in motion against the circumferential surface of said another paper roll, to prevent bouncing of said pressing members.

4. An auto-paster according to claim 3, wherein said control means controls an operation timing of said pressing member applying means.

5. An auto-paster for pasting a paper web which is being drawn out from one paper roll supported on a paper roll support frame, against a circumferential surface of another paper roll to bond said paper web to another paper web from said another paper roll, comprising:

pressing members;

an operating force applying means for operating said pressing members to press quickly said paper web in motion against the circumferential surface of said another paper roll;

a pressing force applying means for suppressing bouncing of said pressing members which occurs after said pressing members have pressed the web into contact with said circumferential surface by applying an additional force urging said pressing members to press said paper web in motion against the circumferential surface of said another paper roll; said pressing force applying means including a fluid cylinder connected to said pressing members and a solenoid control valve connected to said fluid cylinder for actuating said fluid cylinder to apply said additional force urging said pressing members to press said paper web in motion against the circumferential surface of said another paper roll;

a sensor detecting a front end portion of said another paper roll and producing an output signal in response to detection of said front end portion of said another paper roll; and a control means receiving said output signal from said sensor for controlling said operating force applying means and said pressing force applying means, said control means producing a control signal in response to said output signal from said sensor; and wherein said solenoid control valve is connected to receive said control signal from said control means and is responsive to said control signal to actuate said fluid cylinder to cause said pressing force applying means to apply said additional force urging said pressing members to press said paper web in motion against the circumferential surface of said another paper roll, so as to prevent bouncing of said pressing members; and wherein said control means includes a time delay means for delaying switching of said solenoid control valve by a selectable amount of time after said operating force applying means operates said pressing members to press said paper web against the circumferential surface of said another paper roll.

* * * * *